US006112445A

United States Patent [19]

Feeney

[11] Patent Number: 6,112,445

[45] Date of Patent: Sep. 5, 2000

[54] MULTI-PANEL DISPLAY SCREEN WITH ROTATABLE FRAMES

[75] Inventor: Paul W. Feeney, Pelham Manor, N.Y.

[73] Assignee: J.P. Products, LC, New York, N.Y.

[21] Appl. No.: 09/251,240

[22] Filed: Feb. 16, 1999

[51] Int. Cl.[7] ..... A47G 1/16; A47G 1/06

[52] U.S. Cl. ..... 40/747; 40/733; 40/734; 40/765; 160/135

[58] Field of Search ..... 40/729, 732, 733, 40/734, 735, 747, 765, 775, 776, 124.2, 605, 611, 503; 160/135, 353; 211/47, 163, 169

[56] References Cited

U.S. PATENT DOCUMENTS

| | | | |
|---|---|---|---|
| 65,446 | 6/1867 | Sturdevant | 40/503 X |
| 132,314 | 10/1872 | Moulton | 40/732 |
| 437,016 | 9/1890 | Byrnes | 160/135 |
| 846,531 | 3/1907 | Viets | 40/729 X |
| 950,912 | 3/1910 | Harrington . | |
| 1,448,664 | 3/1923 | Hull | 40/729 X |
| 2,432,515 | 12/1947 | Sherbinin | 40/735 X |
| 2,515,053 | 7/1950 | Nesel . | |
| 3,460,282 | 8/1969 | Swirsky | 40/733 X |
| 4,001,959 | 1/1977 | Grendahl . | |
| 4,432,152 | 2/1984 | Daenen . | |
| 4,566,211 | 1/1986 | Gustafson et al. | 40/605 |
| 4,912,866 | 4/1990 | Bannister et al. . | |
| 5,099,589 | 3/1992 | Lai . | |
| 5,280,840 | 1/1994 | Terpening | 211/165 |
| 5,309,657 | 5/1994 | Spencer . | |
| 5,433,036 | 7/1995 | Banal . | |
| 5,544,436 | 8/1996 | Lefowitz | 160/135 X |

*Primary Examiner*—Brian K. Green
*Attorney, Agent, or Firm*—Shughart Thomson & Kilroy P.C.

[57] ABSTRACT

A multi-panel folding display screen includes a plurality of hingedly connected panels with each panel of the screen including a number of display openings there through with the openings being spaced longitudinally along the panel. Within each opening one or more picture frames are mounted so that a collection of photographs can be displayed in the screen. Each picture frame is pivotally mounted relative to the respective panel such that it is rotatable relative to the panel and each frame has a side loading slot so that a pair of photographs can be loaded therein with the photographs being arrayed back to back to face in opposite directions. Each frame can thus be selectively rotated to alternatively exhibit one or the other of the opposing photographs so that the photographic collection can be easily changed.

10 Claims, 2 Drawing Sheets

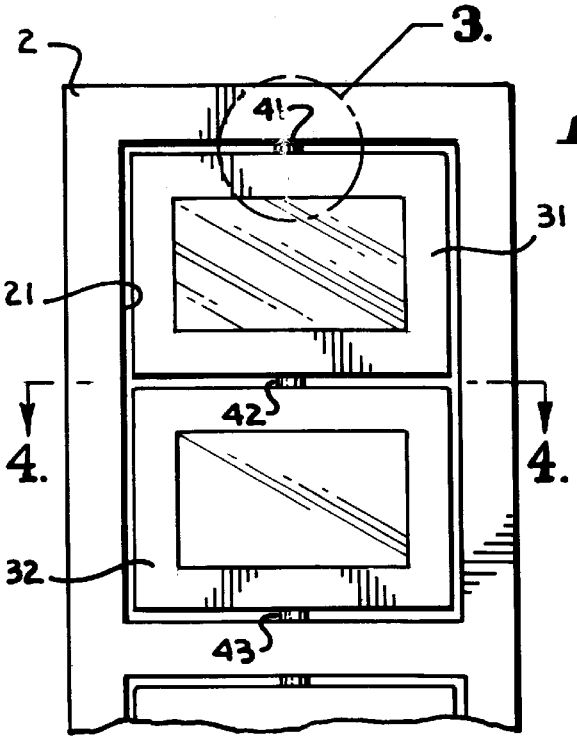
Fig. 2.
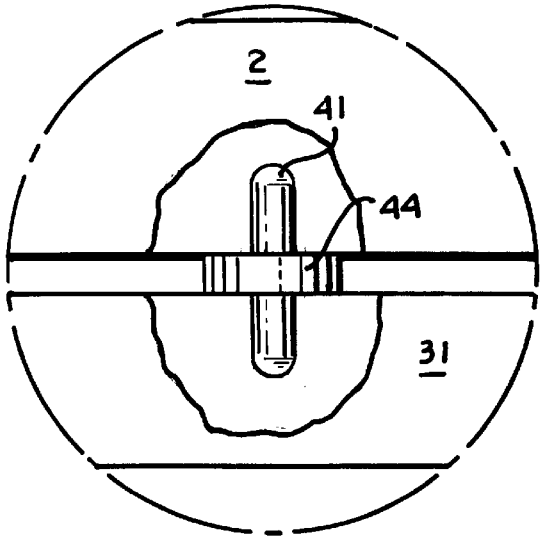
Fig. 3.
Fig. 4.
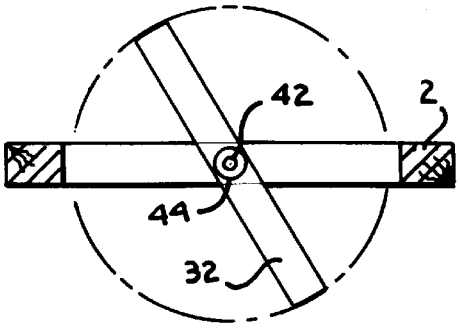
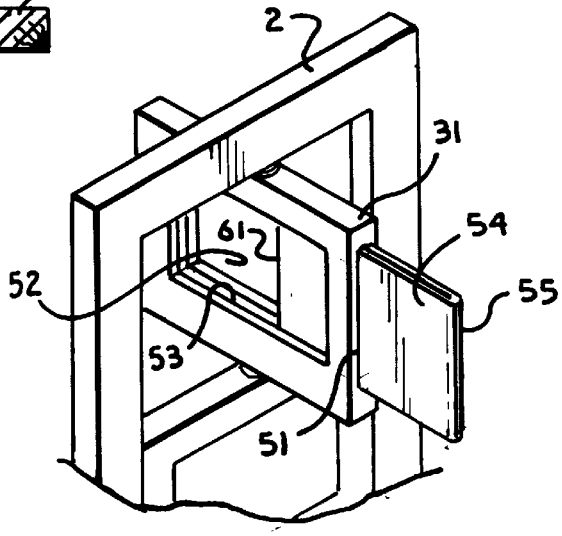
Fig. 5.

MULTI-PANEL DISPLAY SCREEN WITH ROTATABLE FRAMES

FIELD OF THE INVENTION

The present invention relates to a display screen with rotatable frames, and, more particularly, to a multi-panel folding screen with each panel of the screen including a number of rotatable picture frames with each frame accommodating a pair of pictures facing in opposite directions. The frames can be rotated to alternatively display one or the other of the opposing pictures.

BACKGROUND OF THE INVENTION

Display media for exhibiting static photographs and other pictures have taken a wide variety of forms. Traditionally, photographs, paintings and the like have been received and displayed in picture frames which are then mounted in a fixed position on a wall. This practice is somewhat limiting where there is insufficient wall space to display a variety of photographs or pictures. A number of alternative display media have been devised. Some examples of these are found in U.S. Pat. No. 846,531 to Viets, which is directed to a picture cabinet which is a multiple fold screen with a number of panels, each equipped with multiple picture display areas into which picture cards can be inserted via slots; U.S. Pat. No. 950,912 to Harrington, which is directed to a reversible advertisement display board in which an inner frame is pivotable relative to a swing-out outer frame; U.S. Pat. No. 1,448,664 to Hull, which is directed to a dual picture frame which can accommodate two pictures arrayed back to back and in which the frame is pivotable about a vertical axis to reverse the orientation of the frame; U.S. Pat. No. 2,515,053 to Nesel, which is directed to an oval dual picture frame which can accommodate two pictures arrayed back to back and in which the frame is pivotable to reverse the orientation of the frame; U.S. Pat. No. 5,433,036 to Ganal, which is directed to a winged picture frame stand in which a number of double sided clear panels are connected, three per tier, to a post. Each tier of frames can be rotated around the post and each panel can accommodate a pair of pictures loaded through a top edge slot; and U.S. Pat. No. 5,544,436 to Lefkowitz, which is directed to a picture display which includes a tri-fold screen with each panel in the screen including multiple, double sided but fixed picture display areas, each of which can be loaded with back to back photos.

None of these prior art display media allow a collection of photographs to be displayed on a self supporting screen, with each photograph in the collection being selectively reversible so that the collection can be easily changed.

It is clear, then, that a need exists for a free standing display screen which simultaneously displays a number of different photographs or pictures, and in which the pictures are selectively reversible to easily, selectively, change the appearance of the screen.

SUMMARY OF THE INVENTION

The present invention is directed to a multi-panel folding display screen with each panel of the screen including a number of display openings there through with the openings being spaced longitudinally along the panel. Within each display opening, one or more picture frames are mounted so that a collection of photographs or other pictures can be displayed in the screen. Each picture frame is mounted via a pair of pivot pins extending into the top and bottom, respectively, of the frame. Each frame is thus rotatable relative to the panel and each frame has a side loading slot so that a pair of photographs can be loaded therein with the photographs facing in opposite directions. Each frame can thus be selectively rotated to alternatively exhibit one or the other of the opposing photographs so that the photographic collection can be easily changed thereby.

OBJECTS AND ADVANTAGES OF THE INVENTION

The principal objects of the present invention include: providing a free standing photograph or picture display media which is easily changeable; providing such a free standing display media in the form of a multi-panel display screen; providing such a multi-panel display screen which includes a number of panels hinged together with each panel including multiple display openings; providing such a multi-panel display screen in which each display opening in each panel accommodates one or more picture frames which are secured therein via top and bottom centered pivot pins; providing such a multi-panel display screen in which each picture frame has a side loading slot which allows two photographs or pictures to be inserted back to back such that they are facing in opposite directions; providing such a multi-panel display screen in which each frame can be easily, selectively rotated such that either of the opposite facing photographs or pictures can be displayed on either side of each panel; and providing such a multi-panel display screen which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 2 is an enlarged, fragmentary view of an upper portion of one of the display screen panels showing a pair of picture frames rotatably mounted within a display opening thereof.

FIG. 3 is a greatly enlarged, fragmentary view of the portion of the panel circled and indicated at "3" in FIG. 2, with portions of one of the picture frames and the panel broken away to illustrate one of the pivot pin mounts.

FIG. 4 is a cross-sectional view of a portion of the panel of FIG. 2, taken along line 4—4 of FIG. 2, and illustrating one of the rotatable picture frames being rotated relative to the panel.

FIG. 5 is a fragmentary, perspective view of a portion of the panel of FIG. 2, with one of the rotatable picture frames rotated to an approximately 90 degree angle relative to the panel, and with a picture display envelope partially removed via a side slot in the picture frame.

DETAILED DESCRIPTION OF THE INVENTION

Figure 1:
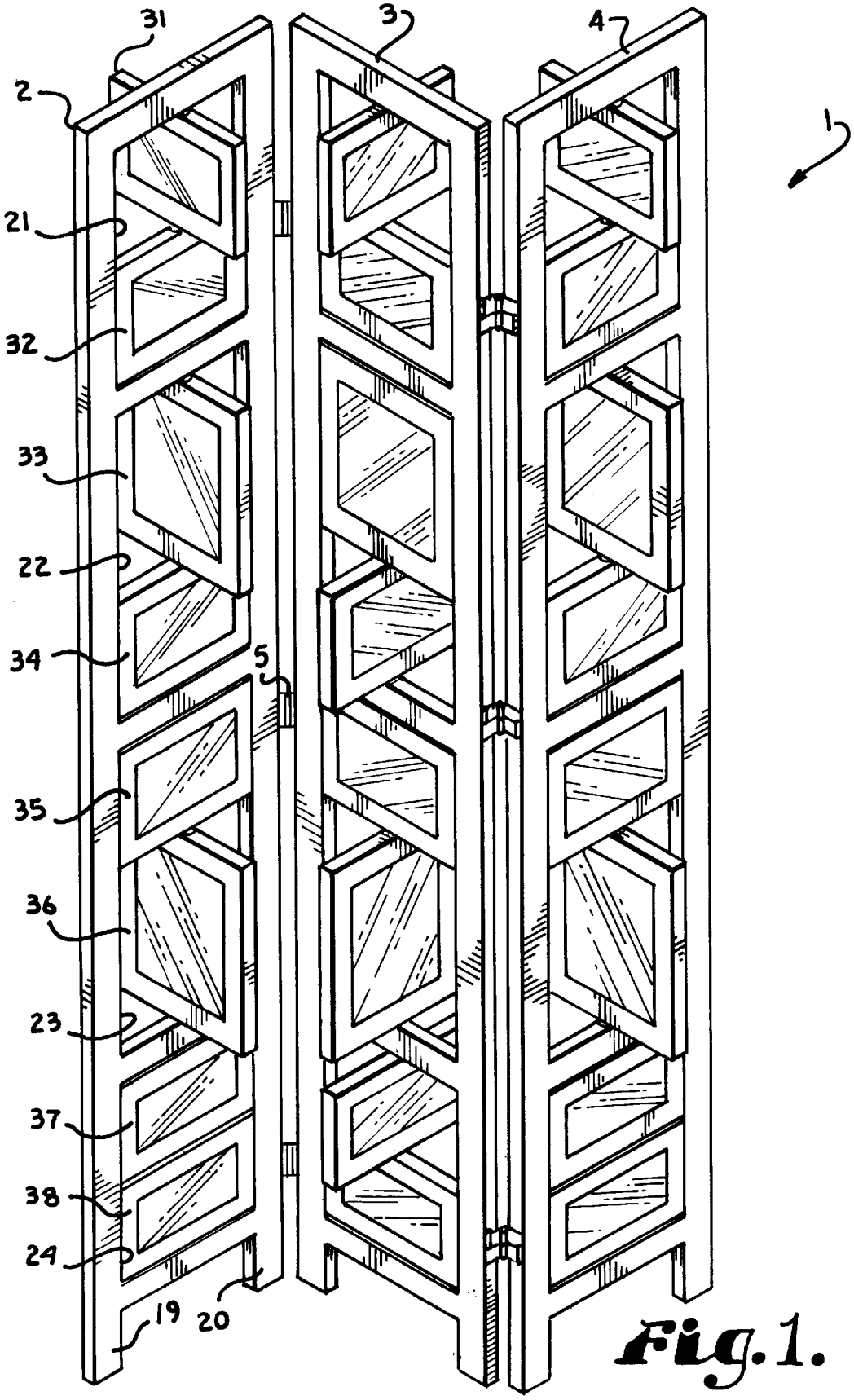
FIG. 1 is a perspective view of a multi-panel display screen in accordance with the present invention, shown with several of its picture frames rotated out of alignment to indicate the capability of the screen.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 1–5, a multi-panel display screen is illustrated and generally indicated at 1. The multi-panel display screen 1 includes three panels 2–4 with the panels 2 and 3 being connected together via a plurality of hinges 5 and the panels 3 and 4 also being connected together via an additional plurality of hinges 5. Each of the hinges 5 is a double hinge which allows the panels 2–4 to be alternatively folded atop each other or opened up to a standing position, as shown in FIG. 1.

Each of the panels 2–4 is otherwise identical, and thus, only the panel 2 will be further described. The panel 2 has a pair of support legs 19 and 20 and includes a number of display openings 21–24, here shown as rectangular in shape. Within each of the display openings 21–24, a pair of picture frames 31–32; 33–34; 35–36; and 37–38, respectively are positioned. Each of the picture frames 31–38 are mounted such that they are pivotable relative to the panel 2. Referring particularly to FIGS. 2–4, each of the frames 31–38 is supported by a pair of pivot pins 41, 42; or 42, 43, depending upon its position within the respective display opening 21–24, with the pins 41–43 being centered in the top edge and/or the bottom edge of each frame 31–38. A plastic spacer 44 is positioned around each pin 41–43 between the respective frame 31–38 and the top or bottom edge of the particular display opening 21–24, or the top or bottom edge of the adjacent frame 31–38. Each of the frames 31–38 is thus supported by a respective pair of the pivot pins 41–43 to be freely rotatable relative to the respective display opening 21–24 within which it is placed. Furthermore, each frame 31–38 is also rotatable relative to the adjacent frame positioned within its particular display opening 21–24.

Referring to FIG. 5, each of the frames 31–38 includes a side opening slot 51 which communicates with a frame center opening 52 of that frame, and each frame 31–38 also includes an interior slot 53 extending around three sides of the frame center opening 52. The side slot 51, the frame center opening 52 and the interior slot 52 are sized to accommodate a transparent picture support envelope 54, which envelope 54 is preferably constructed of plexi-glass or a similar material. Each of the envelopes 53 includes a closed end 55 and an open end 61 via which a pair of photographs (not shown) can be inserted, arrayed back to back. Once the photographs are installed, the envelope 54 is inserted into the respective frame 31–38 via the side slot 51, with the envelope 54 being received by the interior slot 53. With the envelope 54 thus loaded with opposite facing photographs, and received within the frame center opening 53, by rotating each of the frames 31–38 one hunded eighty degrees, either of the two different photographs can be displayed in that frame within each display opening 21–24. Thus, the embodiment of multi-panel display screen 1 illustrated herein, which includes 24 different rotatable frames 31–38, each with two different photographs which can be alternatively displayed, can exhibit a vast number of different combinations of pictures on either side thereof.

While the multi-panel display screen 1 has been illustrated and described in a specific embodiment, it is not to be considered so limited. For example, the rectangular shapes and relative sizes of the panels 2–4, the rectangular shapes of the display openings 21–24 and the picture frames 31–38 in each panel 2–4, and the number of panels, display openings, and frames, are representative only and many other shapes, sizes and numbers could be used for any of these. Furthermore, while the frames 31–38 have been illustrated as rotatable about a centered, vertical axis, they could be rotatable about a horizontal axis instead. Finally, while a multi-panel display screen has been shown and described, a single free standing panel could be substituted with any number of display windows and frames. It is thus to be understood that while certain forms of the present invention have been illustrated and described herein, it is not to be limited to the specific forms or arrangement of parts described and shown.

I claim:

1. A display screen for exhibiting pictures, said display screen comprising:

a. a display panel with a plurality of display openings extending there through;

b. a plurality of picture frames with at least one of said picture frames being positioned within each of said display openings and at least some of said display openings having a plurality of said picture frames positioned therein, each of said picture frames including a center opening adapted to display a pair of pictures arranged back to back such that the pictures face outward from said center opening in opposing directions; and c. a plurality of Divot mounts, each said pivot mount connecting one of said picture frames to said display panel within a respective display opening such that said picture frame is selectively rotatable relative to said display panel.

2. A display screen as in claim 1, wherein each of said pivot mounts comprises an upper and a lower pivot pin extending into a respective one of said picture frames, with said upper pivot pin being centered on an upper edge of the picture frame and with said lower pivot pin being centered on a lower edge of the picture frame.

3. A display screen as in claim 1, wherein each said picture frame includes a side slot communicating with said frame center opening such that the pictures can be inserted or removed from display positions with in the picture frame via said side slot.

4. A display screen as in claim 3, each said picture frame further comprising a transparent envelope which is insertable and removable from said frame center opening via said side slot, each of said transparent envelopes being adapted to hold the pair of pictures arrayed back to back.

5. A multi-panel display screen for exhibiting pictures, said display screen comprising:

a. a plurality of display panels, said display panels being hingedly connected to each other to form said screen, each of said display panels including a plurality of display openings extending there through;

b. a plurality of picture frames with at least one of said picture frames being positioned within each of said display openings and at least some of said display openings having a plurality of said picture frames positioned therein, each of said picture frames including a center opening adapted to display a pair of pictures arrayed back to back such that the pictures face outward from said center opening in opposing directions; and c. a plurality of pivot mounts, each said pivot mount connecting one of said picture frames to one of said display panels within a respective display opening such that said picture frame is selectively rotatable relative to said display panel.

6. A display screen as in claim 5, wherein each of said pivot mounts comprises an upper and a lower pivot pin extending into a respective one of said picture frames, with said upper pivot pin being centered on an upper edge of the picture frame and with said lower pivot pin being centered on a lower edge of the picture frame.

7. A display screen as in claim 5, wherein each said picture frame includes a side slot communicating with said frame center opening such that the pictures can be inserted or removed from display positions within the picture frame via said side slot.

8. A display screen as in claim 7, each said picture frame further comprising a transparent envelope which is insertable and removable from said frame center opening via said side slot, each of said transparent envelopes being adapted to hold a pair of pictures arrayed back to back.

9. A multi-panel display screen for exhibiting pictures, said display screen comprising:

a. a plurality of display panels, said display panels being hingedly connected to each other to form said screen, each of said display panels including a plurality of display openings extending there through;

b. a plurality of picture frames with at least one of said picture frames being positioned within each of said display openings and at least some of said display openings having a plurality of said picture frames positioned therein, each of said picture frames including;

i. a center opening adapted to display a pair of pictures arrayed back to back such that the pictures face outward from said center opening in opposing directions;

ii. a side slot communicating with said frame center opening such that the pictures can be inserted or removed from display positions within the picture frame via said side slot; and iii. a transparent envelope which is insertable and removable from said frame center opening via said side slot, each of said transparent envelopes being adapted to hold the pair of pictures arrayed back to back; and c. a plurality of pivot mounts, each said pivot mount connecting one of said picture frames to one of said display panels within a respective display opening such that said picture frame is selectively rotatable relative to said display panel.

10. A display screen as in claim 9, wherein each of said pivot mounts comprises an upper and a lower pivot pin extending into a respective one of said picture frames, with said upper pivot pin being centered on an upper edge of the picture frame and with said lower pivot pin being centered on a lower edge of the picture frame.

* * * * *